United States Patent [19]

Trevoy et al.

[11] 4,225,422

[45] Sep. 30, 1980

[54] BENEFICIATION OF HEAVY MINERALS FROM BITUMINOUS SANDS RESIDUES BY DRY SCREENING

[75] Inventors: Lloyd Trevoy; Alvin Maskwa, both of Edmonton, Canada

[73] Assignees: Petro-Canada Exploration Inc., Calgary; Her Majesty the Queen in right of the Province of Alberta, Government of the Province of Alberta, Department of Energy and Natural Resources, Alberta Syncrude Equity, Edmonton; PanCanadian Petroleum Limited, Calgary; Esso Resources Canada Ltd., Calgary; Canada-Cities Service, Ltd., Calgary; Gulf Canada Resources Inc., Calgary, all of Canada

[21] Appl. No.: 76,324

[22] Filed: Sep. 17, 1979

[51] Int. Cl.[3] ..... B07B 15/00

[52] U.S. Cl. ..... 209/2; 209/12; 209/38; 209/233; 423/69; 423/73; 423/80; 208/11 LE

[58] Field of Search ..... 209/2–4, 209/10, 12, 17, 38, 44, 233, 237, 311, 315, 355, 235; 423/69, 73, 80; 208/11 LE

[56] References Cited

U.S. PATENT DOCUMENTS

| | | | |
|---|---|---|---|
| 3,068,167 | 12/1962 | White | 210/73 R X |
| 3,328,233 | 6/1967 | Martinez | 209/38 X |
| 3,935,094 | 1/1976 | Bergeron et al. | 423/80 X |
| 3,936,372 | 2/1976 | Frangiskos | 209/3 |
| 4,131,539 | 12/1978 | Ojiri et al. | 423/80 X |
| 4,138,467 | 2/1979 | Kaminsky et al. | 208/11 LE X |

*Primary Examiner*—Ralph J. Hill

*Attorney, Agent, or Firm*—Ernest Peter Johnson

[57] ABSTRACT

The titanium and zirconium-based minerals, present in the first stage centrifuge tailings from the hot water process for extraction of bitumen from bituminous sands, may be concentrated by a dry screening process. The tailings are burned off to provide a dry, essentially carbon-free, mineral mixture. By screening the mixture into three streams of different particle size range, silica and clays may be rejected as coarse and fine materials respectively, while titanium and zirconium minerals may be concentrated in the intermediate stream. The titanium and zirconium concentrate stream may be advanced to high tension and magnetic separation steps known in conventional processing of heavy minerals, for further beneficiation.

1 Claim, 1 Drawing Figure

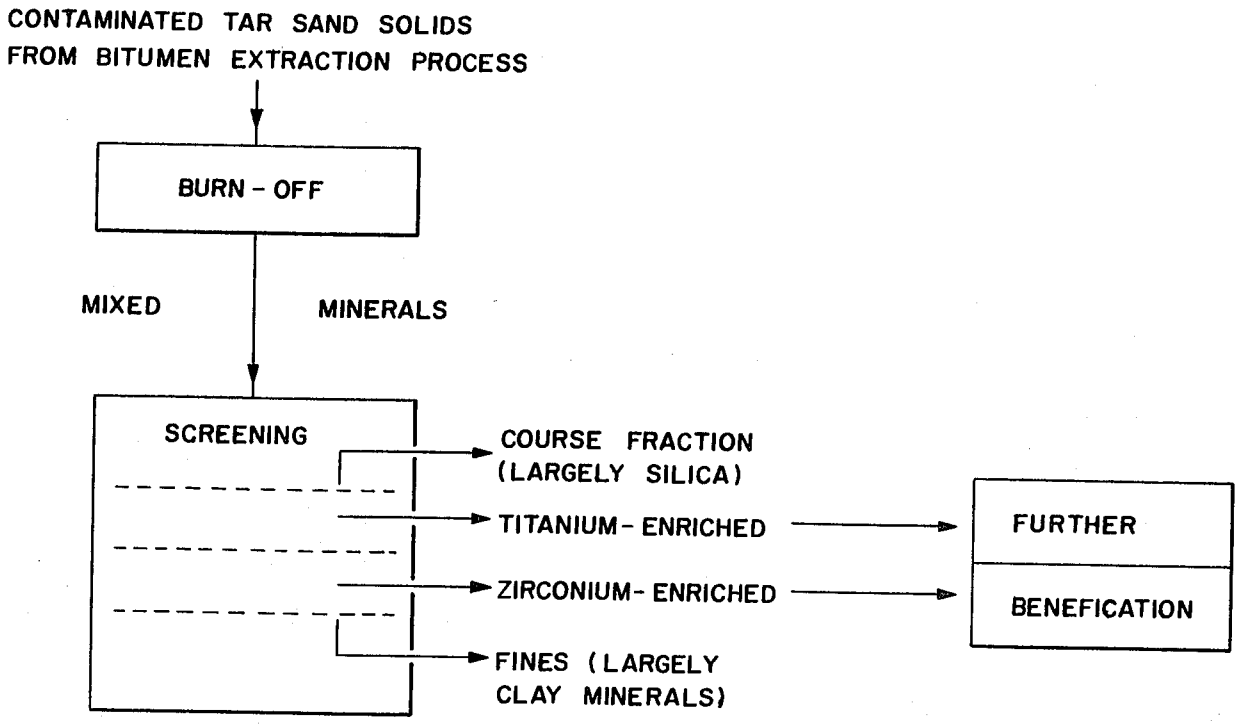
CONTAMINATED TAR SAND SOLIDS
FROM BITUMEN EXTRACTION PROCESS
BURN - OFF
MIXED
MINERALS
SCREENING
COURSE FRACTION
(LARGELY SILICA)
TITANIUM - ENRICHED
ZIRCONIUM - ENRICHED
FINES (LARGELY
CLAY MINERALS)
FURTHER
BENEFICATION

BENEFICIATION OF HEAVY MINERALS FROM BITUMINOUS SANDS RESIDUES BY DRY SCREENING

BACKGROUND OF THE INVENTION

The search for new sources of hydrocarbon fuels has led to the development of novel deposits of naturallyoccurring hydrocarbon material. Among these are the bituminous deposits of northern Alberta in Canada. Taken together, the hydrocarbons present in the McMurray Formation, the largest of these deposits, is estimated as equivalent to 800 billion barrels of crude oil. Because of limitations on surface mining as now practiced, only the top 20 feet or so of tar sand can be mined. Even so, it has been estimated that this portion alone contains the equivalent of 200 billion barrels of crude oil. The principal advantage of the mining route is that it allows bitumen to be extracted from mined tar sand by the highly efficient hot water extraction process, wherein mined tar sand is agitated with steam and water, and sometimes such process aids as sodium hydroxide, and the resulting slurry is advanced to a separatory vessel where much of the bitumen floats as a froth and coarse sand sinks to the bottom and is discarded as a valueless tailings stream. Commonly a middlings stream that takes up an intermediate position in the separatory vessel and that contains typically in the region of 2.25 weight percent bitumen, but in such a form as to be unable to float, is withdrawn and a further yield of bituminous froth obtained therefrom, usually by the forced addition of air. The most common means of isolating the bitumen from the froth streams is to mix the combined froth with a naphtha solvent to produce a mixture of bitumen dissolved in naphtha as well as water and mineral solids and then to centrifuge the resulting mixture. Such centrifuging is commonly performed in two stages, first, using a degritting or scroll centrifuge machine to remove the larger-sized mineral particles, and secondly, in a high speed disc machine to take out substantially all the remaining mineral solids and water leaving a relatively pure solution of bitumen in naphtha solvent. The solvent may then be recovered by flash distillation. The process has been well described in the patent and other scientific literature.

The hot water process and other extractive methods applied to mined tar sand typically extract 93% of the bitumen. This compares very favourably with in-situ methods which, as presently practiced, may recover around 40% of the bitumen.

A less commonly recognized advantage arising from the use of the mining route but one that is involved with the present invention is that it allows isolation or concentration of the heavy minerals, present in the sand of the formation, whereas with in-situ techniques, such minerals remain on the ground. Although the composition of tar sand varies throughout the deposit, tar sand from the McMurray Formation may be said to typically analyze at 11.59 weight percent bitumen, 4.41 weight percent water, 84.00 weight percent mineral solids. Again speaking generally, the more interesting of the mineral solids commonly include quartz (silica), clay, corundum, rutile, ilmenite, leucoxine, zircon, kyanite, apatite, aluminosilicates, garnet, amphiboles, feldspar, monazite, and mica. This list is not necessarily complete for all areas of the deposit.

The minerals fall into groups according to density. The light minerals of density up to 3.0 are principally silica sand ($SiO_2$), ferric oxide (FeO), and ferric carbonate ($FeCO_3$). Those whose density ranges from 3.0 to 4.0 are mostly iron aluminum silicates. The rest of the minerals (ranging in specific gravity from 4.0 to 4.6) contain the zirconium-based and titanium-based minerals of commercial interest. These are mostly ilmenite ($TiO_2.FeO$), leucoxine ($2TiO_2.FeO$), rutile ($TiO_2$), and zircon ($ZrSiO_4$). Of these, the titanium and zirconium minerals are of commercial value after suitable concentration by a beneficiation process, and in fact, the hot water extraction may be looked upon as a first step in heavy minerals' beneficiation.

In froth treatment, most of the heavy minerals report to the tailings from the first-stage or scroll centrifugal separator with the result that such tailings typically analyze at:

8 to 12% iron by weight
5 to 9% titanium by weight
2 to 5% zirconium by weight.

Unlike the free-flowing beach sand used as feed in the conventional heavy metals beneficiation process, for instance in Australia, centrifuge tailings from tar sand extraction are a sticky mass impregnated with bitumen and water.

We have determined that water and organic material may be removed from the centrifuge rejects by a burn-off process. This process is described in U.S. Pat. No. 4,138,467, issued Feb. 6, 1979 which is incorporated herewith by reference. The mechanism, as it is conjectured to occur, may best be described as a 2-stage process. In practice however, it is not necessarily thus carried out. In the first stage (coking), the scroll tailings are introduced into a fluid bed reactor and under an inert atmosphere of nitrogen are heated to 1025° F. or thereabouts. This treatment removes volatiles, including water, probably by a mechanism that includes (a) driving off light hydrocarbons (b) driving off moisture (c) "cracking" some bitumen to gaseous hydrocarbons that are then driven off under the influence of the nitrogen stream (d) "cracking" some bitumen to liquid hydrocarbons that are not volatile under the reaction conditions (e) converting some bitumen to a carbon coke that adheres strongly to the mineral particles. The hydrocarbons that are evolved from the scroll tailings in the fluid bed reactor may be cooled in a condensor and thus recovered. Secondly (burn-off stage), while the fluid bed reactor is at 1025° F. or thereabouts, external heating is discontinued, the nitrogen is switched off, and air or oxygen is fed to the reactor. This causes oxidation of the carbon which excapes from the reactor as gaseous oxides of carbon. In commercial continuous operation the above treatment would most probably be preferably performed in a single step, for instance in a Herreshof or other open hearth furnace.

Such treatment yields a free-flowing product of mineral solids which is an appropriate feed stock for further concentration steps. Such steps may be:

Sieving through a 20 mesh screen
Re-slurrying with water
Treating in a hydrocyclone
Adjusting the water content to give a slurry of 25 to 50 weight percent solids
Concentrating heavier material by a gravity separation in water (for instance by the use of Humphreys' spirals)
Drying Separating into zirconium-rich and titanium-rich fractions under high tension voltage Cleaning and concentrating the zirconium-based and titanium-based minerals by selective magnetic separation.

The present invention notably simplifies beneficiation after the burn-off process thus leading to simplified operation and lower investment without increased losses of the desired minerals.

In the concentrating process for heavy minerals described above, the separatory steps involving water depend upon gravity differences in the various mineral fractions. Taking advantage of this principle the dense particles are successively concentrated and the lighter material rejected. The process carries the disadvantage that it involves expensive drying steps and a relatively large investment in equipment, with attendant complexity in the operation of such equipment.

SUMMARY OF THE INVENTION

By contrast, the process in accordance with the present invention relies upon the much simpler operation of separation by particle size. It has been discovered that when the burned-off first stage centrifuge tailings are sieved in screens of various mesh size, lighter material may be rejected in coarse and fine fractions and zirconium-rich and titanium-rich products concentrated in the intermediate product stream, to provide a concentrate as good as or better than that obtained with the water separation prior process.

It seems that there is a correlation between particle size and mineral identity such that by separating out the very large and very small sized material, one rejects the greater part of the valueless minerals. The principal constituent of the large sized material is silica, while the small sized materials is mainly clays, and, since these streams are mere contaminants, their removal brings about an immediate concentration of the desired heavy minerals.

By the correct selection of screens a useful separation of the zirconium and titantium-based minerals into zirconium-rich and titanium-rich streams may be achieved. Hence, by passing burned-off centrifuge tailings through sieves of successively smaller screen opening the following products may be obtained:

stream low in heavy minerals, largely silica stream relatively rich in titanium minerals stream relatively rich in titanium and zirconium minerals stream low in heavy minerals, largely clays.

Although some titanium minerals are lost in the coarse material and the fines stream, losses at worst are no greater than losses from the conventional aqueous separation.

In the wet separation process, the product from aqueous concentrating steps, after suitable drying, is advanced to further beneficiation using high tension separation and, finally, selective magnetic separation. By the use of the present invention, however, the troublesome preliminary wet steps may be avoided and the two dry streams of intermediate particle size are advanced directly to high tension equipment. But it has a further advantage: the product from aqueous concentration contains a sufficient quantity of finely divided material that high tension separation may be interferred with as a result of arcing in the high voltage field. Screened solids on the other hand, as produced by the invention herein described, being low in fines, present no such arcing problem. Speaking generally, both high tension and magnetic separation are aided by presenting a feed of limited particle size range. Treating burned-off solids by the screening process herein described provides a feed having the desired particle size properties.

Broadly stated, the invention is a dry separatory process for treating first stage scroll centrifuge tailings obtained from hot water extraction processing of bituminous sands, said tailings being dry and substantially carbon free, to concentrate the titanium-based and zirconium-based minerals therefrom. The improvement comprising: screening said tailings in sieves of successively smaller screen opening to give (a) a coarse matter product having more than 75% by weight of minerals of density less than 3.0 (b) a second product of less coarse matter having between 45% and 55% by weight of material of density greater than 3.0 (c) a third product of matter less coarse than in (b) but greater than 44 micron and containing more than 60% by weight of material of density greater than 3.0 (d) a fourth product of fine solids having passed through a sieve of 44 micron screen opening, products (b) and (c) being thereafter advanceable to further beneficiation steps to concentrate titanium-based and zirconium-based minerals therefrom respectively.

DESCRIPTION OF THE DRAWING

The FIGURE is a schematic block diagram of the preferred mode of the process.

DESCRIPTION OF THE PREFERRED EMBODIMENT

The discovery on which the invention is based is illustrated by the following examples:

EXAMPLE I

Scroll centrifuge tailings (100g), after burn-off of bitumen, separated into the following fractions when shaken on a mechanical shaking device:

| Fraction No. | Screen Size of Fraction (Canadian Standard Sieve) | Percentage of Sample Retained (wt) | Titanium Distribution (wt. percent) | Heavy Minerals (S.G. greater than 3.0) in each Fraction % |
|---|---|---|---|---|
| 1 | +100 | 30.8 | 12.7 | 25.4 |
| 2 | −100 +200 | 40.1 | 54.3 | 54.8 |
| 3 | −200 +325 | 18.2 | 23.6 | 68.0 |
| 4 | −325 | 10.6 | 9.4 | 50.3 |

The proportion of heavy minerals was determined by a sinkfloat test. Tetrabromethane (S.G.=3.0 approx.) was taken in a centrifuge tube and a weighed quantity of the mineral mixture added thereto. The tube was shaken to wet all the minerals and the whole then centrifuged. The liquor and light minerals were decanted and the residual solids washed with light solvent such as methanol to remove tetrabromethane. The light solvent was then evaporated out of the solids after which the dry heavy solids were weighed.

EXAMPLE II

Another scroll centrifuge tailings sample (100g). after burn-off bitumen, was shaken on the more efficient "Rotap"* device, i.e. a shaker fitted with an iron hammer that taps the lid of the uppermost screen.

*trade mark

| Fraction No. | Screen Size of Fraction (Cdn. Standard Sieve) | Percentage of Sample Retained (weight) | Titanium Distribution (wt. percent) | Metals Distribution % by weight in fraction | | | | |
|---|---|---|---|---|---|---|---|---|
| | | | | Ti | Zr | Fe | Si | Al |
| 1 | +100 | 15.7 | 4.0 | 2.8 | Nil | 3.4 | 37.3 | 2.0 |
| 2 | +100 + 200 | 52.3 | 58.7 | 12.2 | Nil | 5.2 | 17.0 | 3.0 |
| 3 | −200 + 325 | 19.1 | 25.8 | 14.7 | 5.7 | 7.1 | 18.9 | 2.9 |
| 4 | −325 | 12.7 | 11.5 | 9.9 | 4.8 | 6.3 | 24.2 | 3.2 |

Size of mesh openings for Canadian Standard Sieves are:

| Mesh | Opening μM |
|---|---|
| 100 | 150 |
| 200 | 75 |
| 325 | 45 |

The embodiments of the invention in which an exclusive property or privilege is claimed are defined as follows:

1. In a dry separator process for treating first stage scroll centrifuge tailings obtained from hot water extraction processing of bituminous sands, said tailings being dry and substantially carbon free, to concentrate the titanium-based and zirconium-based minerals therefrom, the improvement comprising:

screening said tailings in sieves of successively smaller screen opening to give (a) a coarse matter product having more than 75% by weight of minerals of density less than 3.0

(b) a second product of less coarse matter having between 45% and 55% by weight of material of density greater than 3.0

(c) a third product of matter less coarse than in (b) but greater than 44 micron and containing more than 60% by weight of material of density greater than 3.0

(d) a fourth product of fine solids having passed through a sieve of 44 micron screen opening, products (b) and (c) being thereafter advanceable to further beneficiation steps to concentrate titanium-based and zirconium-based minerals therefrom respectively.

* * * * *